US005707735A

United States Patent [19]

Midkiff et al.

[11] Patent Number: 5,707,735

[45] Date of Patent: Jan. 13, 1998

[54] MULTILOBAL CONJUGATE FIBERS AND FABRICS

[76] Inventors: David Grant Midkiff, 1975 Thompson Rd.; Samuel Edward Marmon, 4571 Oakhurst La., both of Alpharetta, Ga. 30201

[21] Appl. No.: 617,005

[22] Filed: Mar. 18, 1996

[51] Int. Cl.[6] ..... D02G 3/00

[52] U.S. Cl. ..... 428/373; 428/397

[58] Field of Search ..... 427/373, 374, 427/397

[56] References Cited

U.S. PATENT DOCUMENTS

| | | | |
|---|---|---|---|
| 3,200,440 | 8/1965 | Bryan et al. | 18/8 |
| 3,338,992 | 8/1967 | Kinney | 264/24 |
| 3,341,394 | 9/1967 | Kinney | 161/72 |
| 3,418,200 | 12/1968 | Tanner | 161/177 |
| 3,423,266 | 1/1969 | Davies et al. | 156/167 |
| 3,480,996 | 12/1969 | Matsui | 18/8 |
| 3,502,763 | 3/1970 | Hartman | 264/210 |
| 3,542,615 | 11/1970 | Dobo et al. | 156/181 |
| 3,672,802 | 6/1972 | Matsui et al. | 425/131 |
| 3,692,618 | 9/1972 | Dorschner et al. | 161/72 |
| 3,700,545 | 10/1972 | Matsui et al. | 161/175 |
| 3,725,192 | 4/1973 | Ando et al. | 161/175 |
| 3,780,149 | 12/1973 | Keuchel et al. | 264/168 |
| 3,802,817 | 4/1974 | Matsuki et al. | 425/66 |
| 3,855,046 | 12/1974 | Hansen et al. | 161/150 |
| 3,924,045 | 12/1975 | Ogasawara et al. | 428/373 |
| 4,041,203 | 8/1977 | Brock et al. | 428/157 |
| 4,215,682 | 8/1980 | Kubik et al. | 128/205.29 |
| 4,280,860 | 7/1981 | Shen et al. | 156/167 |
| 4,340,563 | 7/1982 | Appel et al. | 264/518 |
| 4,375,718 | 3/1983 | Wadsworth et al. | 29/592 |
| 4,396,366 | 8/1983 | Kessler et al. | 425/131.5 |
| 4,592,815 | 6/1986 | Nakao | 204/165 |
| 4,787,699 | 11/1988 | Moulin | 350/96.21 |
| 4,791,026 | 12/1988 | Yoshimoto et al. | 428/397 |
| 4,861,660 | 8/1989 | Ishii | 428/371 |
| 4,874,659 | 10/1989 | Ando et al. | 428/221 |
| 5,035,595 | 7/1991 | Nakajima et al. | 425/131.5 |
| 5,057,368 | 10/1991 | Largman et al. | 428/397 |
| 5,069,970 | 12/1991 | Largman et al. | 428/373 |
| 5,087,519 | 2/1992 | Yamaguchi et al. | 428/373 |
| 5,108,820 | 4/1992 | Kaneko et al. | 428/198 |
| 5,125,818 | 6/1992 | Yeh | 425/131.5 |
| 5,162,074 | 11/1992 | Hills | 156/644 |
| 5,169,706 | 12/1992 | Collier, IV et al. | 428/152 |
| 5,178,931 | 1/1993 | Perkins et al. | 428/198 |
| 5,200,443 | 4/1993 | Hudson | 524/99 |
| 5,208,106 | 5/1993 | Tung | 428/397 |
| 5,277,976 | 1/1994 | Hogle et al. | 428/397 |
| 5,336,552 | 8/1994 | Strack et al. | 428/224 |
| 5,354,617 | 10/1994 | Ikkanzaka et al. | 428/397 |

(List continued on next page.)

FOREIGN PATENT DOCUMENTS

| | | |
|---|---|---|
| 25337/92 | 12/1994 | Australia . |
| 2 030 405 | 6/1991 | Canada . |
| 2 105 098 | 4/1994 | Canada . |
| 0 434 029 | 6/1991 | European Pat. Off. . |
| 0 399 397 | 10/1994 | European Pat. Off. . |
| 63-295712 | 12/1988 | Japan . |
| 2-169719 | 6/1990 | Japan . |
| 2-169723 | 6/1990 | Japan . |
| 869 301 | 5/1961 | United Kingdom . |
| 1 075 689 | 7/1967 | United Kingdom . |
| 1 083 240 | 9/1967 | United Kingdom . |
| 1 459 597 | 12/1976 | United Kingdom . |

OTHER PUBLICATIONS

Fairchild's Dictionary of Textiles 1996 pp. 539–540.

*Primary Examiner*—Newton Edwards
*Attorney, Agent, or Firm*—James B. Robinson

[57] ABSTRACT

A conjugate multilobal fiber and a fabric made therefrom is provided. The fiber comprises at least two polymers arranged with at least one polymer occupying a portion of the fiber and at least one other polymer having a lower melting point than the first portion polymer occupying an outer portion of the fiber. The polymers can be arranged in a number of configurations depending on the planned use of the web.

7 Claims, 3 Drawing Sheets

U.S. PATENT DOCUMENTS

| | | | |
|---|---|---|---|
| 5,380,592 | 1/1995 | Tung | 428/397 |
| 5,382,400 | 1/1995 | Pike et al. | 428/373 |
| 5,401,446 | 3/1995 | Tsai et al. | 264/22 |
| 5,418,045 | 5/1995 | Pike et al. | 428/373 |
| 5,425,987 | 6/1995 | Shawver et al. | 428/374 |
| 5,458,972 | 10/1995 | Hagen | 428/373 |
| 5,466,410 | 11/1995 | Hills | 264/172.11 |
| 5,482,772 | 1/1996 | Struck et al. | 428/374 |
| 5,512,358 | 4/1996 | Shawver et al. | 428/37 |

MULTILOBAL CONJUGATE FIBERS AND FABRICS

BACKGROUND OF THE INVENTION

This invention relates generally to thermoplastic resin nonwoven filaments or fibers and fabrics or webs which are formed from the fibers, and laminates using a web as a component. The fabric may be used as a filter and in personal care product applications as, for example, a diaper outercover or a liner for feminine hygiene products. Various treatment chemicals may be applied to the fabric to enhance certain properties.

Thermoplastic resins have been extruded to form fibers, fabrics and webs for a number of years. The most common thermoplastics for this application are polyolefins, particularly polypropylene. Other materials such as polyesters, polyetheresters, polyamides and polyurethanes are also used to form nonwoven fabrics, like for example, spunbond fabrics.

Nonwoven fabrics or webs are useful for a wide variety of applications such as components of diapers, feminine hygiene products, towels, recreational or protective fabrics and as geotextiles and filter media. The nonwoven webs used in these applications may be simply spunbond fabrics but are often in the form of nonwoven fabric laminates like spunbond/spunbond (SS) laminates or spunbond/meltblown/spunbond (SMS) laminates which are defined herein.

As filter media, some of the desired characteristics of nonwoven fabrics are that they be permeable to the fluid being filtered yet have a high filtration efficiency. Permeability to the fluid being filtered is quite important as low permeability could result in a high pressure drop across the filter requiring a higher, and hence more costly, energy input into the filtered fluid and a shortening of filter life.

High filtration efficiency is, of course, the main purpose for a filter and great efficiency and ability to maintain the efficiency at an acceptable level are keys to filter performance. In addition, specific properties of filter media such as odor control are important. This is true in the developing field of filtration of transportation vehicle cabin air where the vehicle may travel through various industrial areas and be exposed to a multitude of odors. Removing these odors from the air the passengers breathe is an objective of this evolving field of filtration. Such filters may also be used in air filtration for home or commercial heating, ventilating and air conditioning (HVAC) systems. While filters using this invention are directed mainly to air filtration, other gasses may be filtered as well.

It has been found that by shaping fibers in an unusual way, odor treatment chemicals may be applied to the fibers and will remain in place longer than on conventional round fibers. In addition, the inventors have found that by making parts of the fiber from different polymers, the density, bonding and other characteristics of the fabric may be easily controlled.

It is an object of this invention to provide spunbond polyolefin nonwoven fibers for use in a fabric or web which have a unique shape, are made from a variety of of polymers and which can be made into a fabric or web having controllable density and good bondability. It is a further object to provide a web having the ability to be impregnated with odor control chemicals and presenting the odor capturing chemicals to a stream of air being filtered.

SUMMARY OF THE INVENTION

The objectives of this invention are met by a conjugate multilobal spunbond fiber comprising at least two polymers where the fibers have lobes and each lobe has legs and caps, and the polymers are arranged with a first polymer occupying a portion of the fiber and at least one second polymer having a lower melting point than the first polymer occupying another portion of the fiber. The fibers may be crimped by the application of heated air, may be split into smaller fibers and may be made into a fabric or web by bonding them together, by, for example, through-air bonding. The web may be treated with surfactants and impregnated with odor treating chemicals and may be electret treated.

DEFINITIONS

Figure 1:
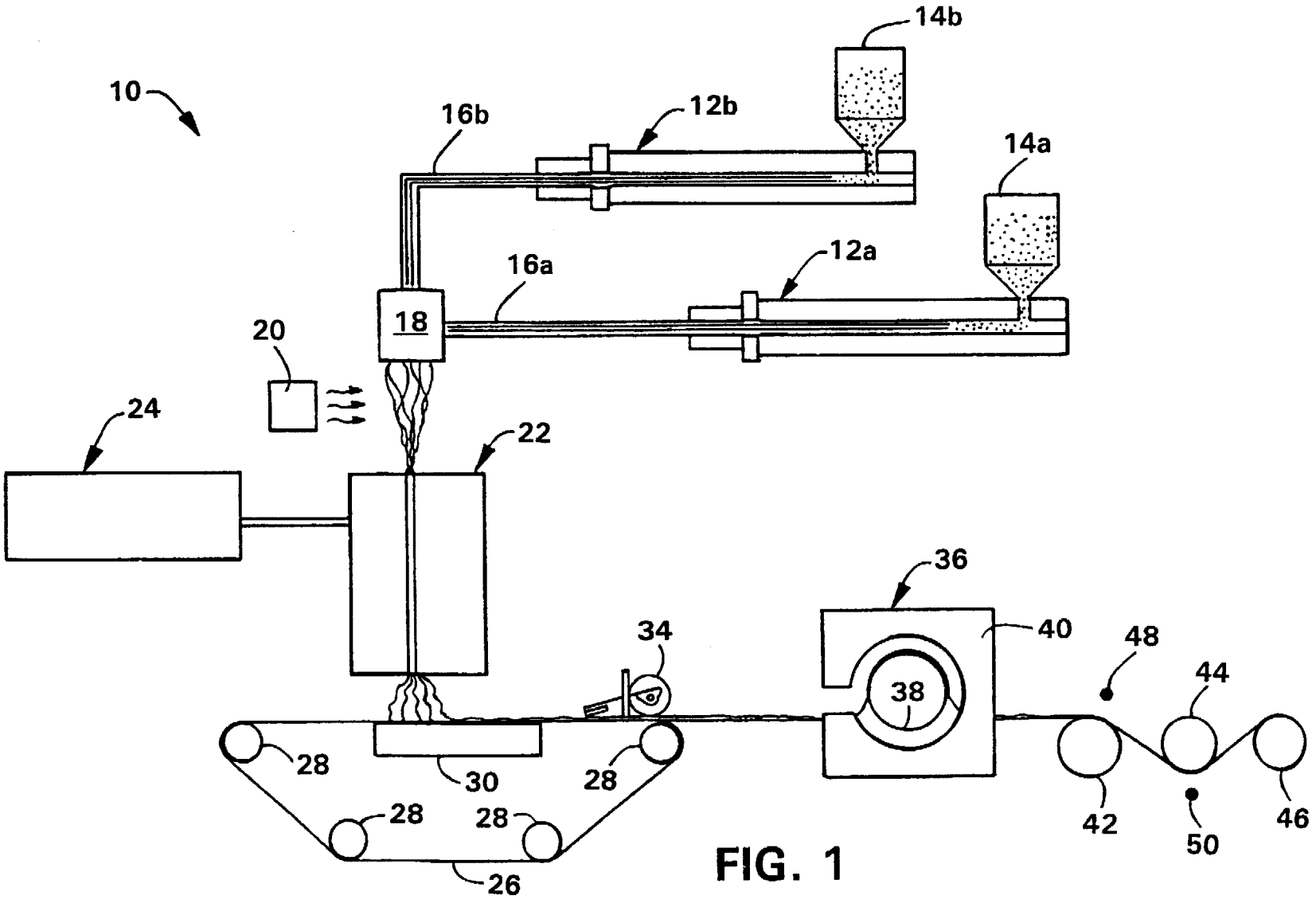
FIG. 1 is a schematic drawing of an apparatus for producing the fibers of this invention.

As used herein the term "nonwoven fabric or web" means a web having a structure of individual fibers or threads which are interlaid, but not in an identifiable manner as in a knitted fabric. Nonwoven fabrics or webs have been formed from many processes such as, for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 000707. Thus, a 15 micron polypropylene fiber has a denier of about 1.42 ($15^2 \times 0.89 \times 000707 = 1.415$). Outside the United States the unit of measurement is more commonly the "tex", which is defined as the grams per kilometer of fiber. Tex may be calculated as denier/9. While the previous discussion fo denier is useful for round fibers, it is insufficient to properly define denier for the multilobal fibers of this invention. Multilobal fiber denier is based on fiber cross-sectional area in square microns and is calculated as $D=A * p * 0.099$, where D is denier, A is fiber cross-sectional are in square microns, p is the polymer density in grams/cc and 0.009 is a conversion constant. The cross-sectional area (A) is the area of polymer only, not void space, and may be ascertained by using, for example, a video micrometer, which can be used to see a magnified view of the end of a fiber.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No.

3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (using a sample size of at least 10) larger than 7 microns, more particularly, between about 10 and 25 microns.

As used herein, the term "hot air knife" or HAK means a process of pre- or primarily bonding a just produced microfiber, particularly spunbond, web in order to give it sufficient integrity, i.e. increase the stiffness of the web, for further processing, but does not mean the relatively strong bonding of secondary bonding processes like TAB, thermal bonding and ultrasonic bonding. A hot air knife is a device which focuses a stream of heated air at a very high flow rate, generally from about 1000 to about 10000 feet per minute (fpm) (305 to 3050 meters per minute), or more particularly from about 3000 to 5000 feet per minute (915 to 1525 m/min.) directed at the nonwoven web immediately after its formation. The air temperature is usually in the range of the melting point of at least one of the polymers used in the web, generally between about 200° and 550° F. (93° and 290° C.) for the thermoplastic polymers commonly used in spunbonding. The control of air temperature, velocity, pressure, volume and other factors helps avoid damage to the web while increasing its integrity. The HAK's focused stream of air is arranged and directed by at least one slot of about ⅛ to 1 inches (3 to 25 mm) in width, particularly about ⅜ inch (9.4 mm), serving as the exit for the heated air towards the web, with the slot running in a substantially cross-machine direction over substantially the entire width of the web. In other embodiments, there may be a plurality of slots arranged next to each other or separated by a slight gap. The at least one slot is usually, though not essentially, continuous, and may be comprised of, for example, closely spaced holes. The HAK has a plenum to distribute and contain the heated air prior to its exiting the slot. The plenum pressure of the HAK is usually between about 1.0 and 12.0 inches of water (2 to 22 mmHg), and the HAK is positioned between about 0.25 and 10 inches and more preferably 0.75 to 3.0 inches (19 to 76 mm) above the forming wire. In a particular embodiment the HAK plenum's cross sectional area for cross-directional flow (i.e. the plenum cross sectional area in the machine direction) is at least twice the total slot exit area. Since the foraminous wire onto which spunbond polymer is formed generally moves at a high rate of speed, the time of exposure of any particular part of the web to the air discharged from the hot air knife is less a tenth of a second and generally about a hundredth of a second in contrast with the through air bonding process which has a much larger dwell time. The HAK process has a great range of variability and controllability of many factors such as air temperature, velocity, pressure, volume, slot or hole arrangement and size, and the distance from the HAK plenum to the web.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the crossection of the conjugate fibers and extend continuously along the length of the conjugate fibers. The configuration of such a conjugate fiber may be, for example, a sheath/core arrangement wherein one polymer is surrounded by another or may be a side by side arrangement, a segmented configuration or an "islands-in-the-sea" arrangement. Conjugate fibers are taught in U.S. Pat. No. 5,108,820 to Kaneko et al., U.S. Pat. Nos. 5,336,552 and 5,482,772 to Strack et al., and U.S. Pat. No. 5,382,400 to Pike et al., hereby incorporated by reference in their entirety. For two component fibers, the polymers may be present in ratios of 75/25, 50/50, 25/75 or any other desired ratios.

As used herein "thermal point bonding" involves passing a fabric or web of fibers to be bonded between a heated calender roll and an anvil roll. The calender roll is usually, though not always, patterned in some way so that the entire fabric is not bonded across its entire surface and the anvil is usually flat. As a result, various patterns for calender rolls have been developed for functional as well as aesthetic reasons. One example of a pattern is the Hansen Pennings or "H&P" pattern with between about a 5 and 50% bond area with between about 50–3200 bonds/square inch as taught in U.S. Pat. No. 3,855,046 to Hansen and Pennings. One example of the H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). Another typical point bonding pattern is the expanded Hansen Pennings or "EHP" bond pattern which produces about a 15% bond area with a square pin having a side dimension of 0.037 inches (0.94 mm), a pin spacing of 0,097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. As in well known in the art, the spot bonding holds the laminate layers together as well as imparts integrity to each individual layer by bonding filaments and/or fibers within each layer.

As used herein, through air bonding or "TAB" means a process of bonding a nonwoven conjugate fiber web in which air which is sufficiently hot to melt one of the polymers of which the fibers of the web are made is forced through the web. The air velocity is normally between 100 and 500 fpm (30–152 m/min.) and the dwell time may be as long as 60 seconds. The air temperature may be between about 230° and 325° F. (110°–162° C.), depending on the melting points of the polymers used. The melting and resolidification of the polymer provides the bonding. Through-air bonding requires the melting of at least one component to accomplish bonding so it is restricted to webs with at least two components like conjugate fibers or webs which include an adhesive as fibers or in some other form.

As used herein, the term "personal care product" means diapers, training pants, absorbent underpants, adult incontinence products, and feminine hygiene products.

DETAILED DESCRIPTION

More and more concern in the transportation industry is focusing on the quality of air being breathed by passengers, most especially the automotive industry. Many cars for sale in the U.S. are adding "cabin air filters" to remove particulates from the passengers'air. The next generation of these filters will remove not only particulates but also odors. While some success in odor removal has come from the use of activated carbon, such filters do not provide the large capacity needed for automotive applications.

One method of controlling odors is to coat filter fibers with an odor absorbing or masking chemical. Over time, however, the effectiveness of such chemicals is reduced as they evaporate from the fiber or are carded away as entrained droplets in the filtered air.

Another method of odor control is proposed by Allied-Signal Automotive of Perryburg, Ohio, which uses trilobal monocomponent fibers believed to be those taught in U.S. Pat. No. 5,057,368. Trilobal monocomponent fibers, while an advance over past techniques do not have the processibility advantages of the instant invention.

The inventors have found that webs formed of conjugate fibers, instead of mere monocomponent fibers, and shaped in ways meant to enhance liquid retention, can provide a filter media with sufficient capacity for automotive applications and provides much greater design flexibility for the filter designer. This filter fiber has "lobes" to hold the liquid in place and the lobes are made from particular polymers which are hydrophilic or which may be treated for hydrophilicity. These fibers are spunbond fibers made from at least two polymers as conjugate fibers and have at least one lobe for holding liquid. Conjugate fibers may be split, crimped and through-air bonded. Combining the advantages of the liquid retention of multilobal fibers with the processing advantages of conjugate fiber results in a fabric having improved processibility a myriad of different webs having properties tailored to the needs of the user.

The spunbond process generally uses a hopper which supplies polymer to a heated extruder. The extruder supplies melted polymer to a spinneret where the polymer is fiberized as it passes through fine openings arranged in one or more rows in the spinneret, forming a curtain of filaments. The filaments are usually quenched with air at a low pressure, drawn, usually pneumatically and deposited on a moving foraminous mat, belt or "forming wire" to form the nonwoven web. Polymers useful in the spunbond process commonly have a process melt temperature of between about 400° F. to about 610° F. (200° C. to 320° C.).

The fibers produced in the spunbond process are usually in the range of from about 10 to about 50 microns in average diameter, depending on process conditions and the desired end use for the webs to be produced from such fibers. For example, increasing the polymer molecular weight or decreasing the processing temperature results in larger diameter fibers. Changes in the quench fluid temperature and pneumatic draw pressure can also affect fiber diameter. The fibers used in the practice of this invention usually have average diameters in the range of from about 7 to about 35 microns, more particularly from about 15 to about 25 microns.

The fibers used to produce the web of this invention are conjugate fibers. As these conjugate fibers are produced and cooled, the differing coefficients of expansion of the polymers can cause these fibers to bend and ultimately to crimp, somewhat akin to the action of the bimetallic strip in a conventional room thermostat. Crimped fibers are described in U.S. Pat. No. 5,382,400 wherein fibers are crimped with the same air as is used to draw them. Sufficiently warm drawing air activates the latent helical crimp of the fibers as the fibers are produced and before they are deposited on the forming wire. Crimped fibers have an advantage over uncrimped fibers in that they produce a more bulky web which therefore increases fabric or web permeability. High permeability is a very desirable characteristic for a filter and so crimped fiber filters are more desirable than uncrimped fiber filters. Additionally, the degree of crimp can be controlled by controlling the temperature of the drawing air, thereby providing a mechanism for controlling the web density. Generally, a higher air temperature produces a higher number of crimps. This allows one to change the resulting density, pore size distribution and stiffness of the filter media web by simply adjusting the temperature of the air in the fiber draw unit.

Split or fibrillated fine fibers exhibit highly desirable properties, including textural, visual and strength properties. There are different known processes for producing split fine fibers, and in general, split fibers are produced from conjugate fibers which contain two or more incompatible polymer components or from an axially oriented film. For example, a known method for producing split fibrous structures includes the steps of forming splittable conjugate filaments into a fabric and then treating the fabric with an aqueous emulsion of benzyl alcohol or phenyl ethyl alcohol to split the conjugate filaments. Another known method has the steps of forming splittable conjugate filaments into a fibrous structure and then splitting the conjugate filaments by flexing or mechanically working the filaments in the dry state or in the presence of a hot aqueous solution. Yet another commercially utilized method for producing split fine denier fibers is a needling process. In this process, conjugate fibers are hydraulically or mechanically needled to separate the different polymer components of the conjugate fibers. Further yet another method for producing fine fibers, although it may not be a fiber splitting process, utilizes conjugate fibers that contain a solvent or water soluble polymer component. For example, a fibrous structure is produced from sheath-core conjugate fibers and then the fibrous structure is treated with a solvent that dissolves the sheath component to produce a fibrous structure of fine denier fibers of the core component. For the purposes of this invention, split conjugate fibers may be produced from any method which is effective.

The polymers suitable for the present invention include polyolefins, polyesters, polyamides, polycarbonates, polyurethanes, polyvinylchloride, polytetrafluoroethylene, polystyrene, polyethylene terephathalate, and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly(1-butene) and poly(2-butene); polypentene, e.g., poly(1-pentene) and poly(2-pentene); poly(3-methyl-1-pentene); poly(4-methyl 1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, polybutylene terephthalate, polytetramethylene terephthalate, polycyclohexylene-1,4-dimethylene terephthalate, and isophthalate copolymers thereof, as well as blends thereof.

Many polyolefins are available commercially for fiber production, for example polyethylenes such as Dow Chemical's ASPUN® 6811A linear low density polyethylene, 2553 LLDPE and 25355 and 12350 high density polyethylene are such suitable polymers. The polyethylenes have melt flow rates in g/10 min. at 190° F. and a load of 2.16 kg, of about 26, 40, 25 and 12, respectively. Fiber forming polypropylenes include Exxon Chemical Company's ESCORENE® PD 3445 polypropylene and Himont Chemical Co.'s PF-304 and PF-305. Many other fiber forming polyolefins are commercially available.

Examples of polyamides and their methods of synthesis may be found in "Polymer Resins" by Don E. Floyd (Library of Congress Catalog number 66-20811, Reinhold Publishing, N.Y., 1966). Particularly commercially useful polyamides are nylon-6, nylon-6,6, nylon-11 and nylon-12. These polyamides are available from a number of sources such as Nyltech North America of Manchester, N.H., Emser Industries of Sumter, S.C. (Grilon® & Grilamid® nylons) and Atochem Inc.

Polymers Division, of Glen Rock, N.J. (Rilsan® nylons), among others. In addition, a compatible tackifying resin may be added to the extrudable compositions described above to provide tackified materials that autogenously bond or which require heat for bonding. Any tackifier resin can be used which is compatible with the polymers and can withstand the high processing (e.g., extrusion) temperatures. If the polymer is blended with processing aids such as, for example, polyolefins or extending oils, the tackifier resin should also be compatible with those processing aids. Generally, hydrogenated hydrocarbon resins are preferred tackifying resins, because of their better temperature stability. REGALREZ® and ARKON® P series tackifiers are examples of hydrogenated hydrocarbon resins. ZONATAC® 501 lite is an example of a terpene hydrocarbon. REGALREZ® hydrocarbon resins are available from Hercules Incorporated. ARKON® P series resins are available from Arakawa Chemical (USA) Incorporated. The tackifying resins such as disclosed in U.S. Pat. No. 4,787,699, hereby incorporated by reference, are suitable. Other tackifying resins which are compatible with the other components of the composition and can withstand the high processing temperatures, can also be used.

It is also possible to have other materials blended in minor amounts with the polymers used to produce the nonwoven layer according to this invention like fluorocarbon chemicals to enhance chemical repellence which may be, for example, any of those taught in U.S. Pat. No. 5,178,931, fire retardants, ultraviolet radiation resistance improving chemicals and pigments to give each layer the same or distinct colors. Fire retardants and pigments for spunbond and meltblown thermoplastic polymers are known in the art and are internal additives. A pigment, e.g. $TiO_2$, if used, is generally present in an amount less than 5 weight percentage of the layer while other materials may be present in a cumulative amount less than 25 weight percent.

Ultraviolet radiation resistance improving chemical may be, for example, hindered amines and other commercially available compounds. Hindered amines are discussed in U.S. Pat. No. 5,200,443 to Hudson and examples of such amines are Hostavin TMN 20 from American Hoescht Corporation of Somerville, N.J., Chimassorb® 944 FL from the Ciba-Geigy Corporation of Hawthorne, N.Y., Cyasorb UV-3668 from American Cyanamid Company of Wayne, N.J. and Uvasil-299 from Enichem Americas, Inc. of N.Y.

It is important that the particular polymers used for the different components of the fibers in the practice of the invention have melting points different from one another. This is important not only in producing crimped fibers but also in throughair bonding wherein the lower melting polymer bonds the fibers together to form the fabric or web. More particularly, the lower melting component must be located in an outer portion of the fiber so that it comes in contact with other fibers.

The shape of the fibers used in the practice of this invention must provide areas in which liquids may be retained. Preferred shapes are those described in U.S. Pat. Nos. 5,069,970 and 5,057,368 to Largman et al., hereby incorporated by reference in their entirety, which describe fibers with unconventional shapes. None of these references, however, suggest conjugate fibers or the unique advantages of such fibers in crimping, splitting, varying web pore size or bonding and which are important factors determining the usefulness of such fibers when used to create a web filter media. Its possible that the shape of fibers of 5,277,976 to Hogle et al. may also be used, though the inventors have not investigated Hogle's teachings thoroughly.

After the fibers are produced onto a forming wire with the desired degree of crimp, they are through-air bonded. Through-air bonding is preferred because it does not appreciably reduce web pore size and therefore permeability when compared, for example, to thermal point bonding. Through-air bonding creates small bonds at almost every fiber crossover point, minimally effecting the permeability of the web. Thermal point bonding by contrast results in comparatively large bonds at discrete points, compressing the web in areas around the bond points which decreases the permeability of the web. After through-air bonding the web may be electret treated. Electret treatment further increases filtration efficiency by drawing particles to be filtered toward the filter by virtue of their electrical charge. Electret treatment can be carded out by a number of different techniques. One technique is described in U.S. Pat. No. 5,401,446 to Tsai et al. assigned to the University of Tennessee Research Corporation and incorporated herein by reference in its entirety. Tsai describes a process whereby a web or film is sequentially subjected to a series of electric fields such that adjacent electric fields have substantially opposite polarities with respect to each other. Thus, one side of the web or film is initially subjected to a positive charge while the other side of the web or film is initially subjected to a negative charge. Then, the first side of the web or film is subjected to a negative charge and the other side of the web or film is subjected to a positive charge. Such webs are produced with a relatively high charge density without an attendant surface static electrical charge. The process may be carded out by passing the web through a plurality of dispersed non-arcing electric fields which may be varied over a range depending on the charge desired in the web. The web may be charged at a range of about 1 kVDC/cm to 12 kVDC/cm or more particularly 4 kVDC/cm to 10 kVDC/cm and still more particularly 7 kVDC/cm to about 8 kVDC/cm.

Other methods of electret treatment are known in the art such as that described in U.S. Pat. Nos. 4,215,682 to Kubik et al, 4,375,718 to Wadsworth, 4,592,815 to Nakao and 4,874,659 to Ando.

The fabric of this invention may be a multilayer laminate and may be formed by a number of different techniques including but not limited to using adhesive, needle punching, ultrasonic bonding, thermal calendering and through-air bonding. Such a multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al. or as a spunbond/spunbond may be made by sequentially depositing onto a moving conveyor belt or forming wire first a spunbond web layer, then a meltblown web layer and last another spunbond layer and then bonding the laminate in a manner described above.

Alternatively, as sequential deposition of SMS layers is a difficult process to control satisfactorily, the three web layers may be made individually. collected in rolls and combined in a separate bonding step.

The fabric may also be a laminate of spunbond fabric and scrim materials. Scrim materials provide little mass and essentially no filtration ability but do provide an additional degree of integrity or strength to the fabric. Scrims usually are fibers bonded together to produce a square pattern of openings, each of which is quite large, e.g. as much as 5 inches (127 mm) by 5 inches, though the pattern need not be exactly square. Scrims may be, for example, 3 inches (76 mm) by 2 inches (51 mm), 4 inches (101 mm) by 4 inches, and 3 inches (76 mm) by 3 inches. When a scrim is used it should be place between two other layers so that its ability to provide integrity to the fabric is maximized. Scrims may be made from any polymer known conventionally as being used for that purpose, examples include, polypropylene, ethyl vinyl acetate (EVA), polyamides, polyurethane, polybutylene, polystyrene, polyvinyl chloride, polyethylene, polyethylene terephathalate, and polytetrafluoroethylene.

Turning to FIG. 1, a process line 10 for preparing an embodiment of the present invention is disclosed. The process line 10 is arranged to produce conjugate continuous filaments, but it should be understood that the present invention comprehends nonwoven fabrics made with multicomponent filaments having more than two components. For example, the fabric of the present invention can be made with filaments having three or four components. The process line 10 includes a pair of extruders **12*a* and 12*b* for separately extruding a polymer component A and a polymer component B. Polymer component A is fed into the respective extruder 12*a* from a first hopper 14*a* and polymer component B is fed into the respective extruder 12*b* from a second hopper 14*b*. Polymer components A and B are fed from the extruders 12*a* and 12*b* through respective polymer conduits 16*a* and 16*b* to a spinneret 18. Spinnerets for extruding conjugate filaments are well-known to those of ordinary skill in the art and thus are not described herein in detail. Generally described, the spinneret 18 includes a housing containing a spin pack which includes a plurality of plates stacked one on top of the other with a pattern of openings arranged to create flow paths for directing polymer components A and B separately through the spinneret. The spinneret 18** has openings arranged in one or more rows. The spinneret openings form a downwardly extending curtain of filaments.

The process line 10 also includes a quench air blower 20 positioned adjacent the curtain of filaments extending from the spinneret 18. The quench air can be directed from one side of the filament curtain as shown in FIG. 1, or both sides of the filament curtain.

A fiber draw unit or aspirator 22 is positioned below the spinneret 18 and receives the quenched filaments. Fiber draw units or aspirators for use in melt spinning polymers are well-known as discussed above. Suitable fiber draw units for use in the process of the present invention include a linear, fiber aspirator of the type shown in U.S. Pat. No. 3,802,817 and eductive guns of the type shown in U.S. Pat. Nos. 3,692,618 and 3,423,266, the disclosures of which are incorporated herein by reference.

Generally described, the fiber draw unit 22 includes an elongate vertical passage through which the filaments am drawn by aspirating air entering from the sides of the passage and flowing downwardly through the passage. A heater 24 supplies hot aspirating air to the fiber draw unit 22. The hot aspirating air draws the filaments and ambient air through the fiber draw unit.

An endless foraminous forming surface 26 is positioned below the fiber draw unit 22 and receives the continuous filaments from the outlet opening of the fiber draw unit. The forming surface 26 travels around guide rollers 28. A vacuum box 30 positioned below the forming surface 26 where the filaments are deposited draws the filaments against the forming surface.

The process line 10 as shown also includes a compaction roller 34 which compacts the web as the web is drawn off of the forming surface 26. The compaction roll 34 may alternatively be replaced by a hot-air knife which uses high velocity warm air to give minimal integrity to the web for further processing. In addition, the process line includes a bonding apparatus which is a through-air bonder 36. After passing through the through-air bonder, the web may be passed between a charging wire or bar 48 and a charged roller 42 and then between a second charging wire or bar 50 and roller 44.

Lastly, the process line 10 includes a winding roll 42 for taking up the finished fabric.

To operate the process line 10, the hoppers **14*a* and 14*b* are filled with the respective polymer components A and B. Polymer components A and B are melted and extruded by the respective extruders 12*a* and 12*b* through polymer conduits 16*a* and 16*b* and the spinneret 18**. Although the temperatures of the molten polymers vary depending on the-polymers used, when polypropylene and polyethylene are used as components A and B respectively, the preferred temperatures of the polymers range from about 370° to about 530° F. and preferably range from 400° to about 450° F.

As the extruded filaments extend below the spinneret 18, a stream of air from the quench air blower 20 at least partially quenches the filaments to develop a latent helical crimp in the filaments at an air temperature of about 45° to about 90° F. and a velocity from about 100 to about 400 feet per minute.

After quenching, the filaments are drawn into the vertical passage of the fiber draw unit 22 by a flow of hot air from the heater 24 through the fiber draw unit. The fiber draw unit is preferably positioned 30 to 60 inches below the bottom of the spinneret 18. The temperature of the air supplied from the heater 24 is sufficient that, after some cooling due to mixing with cooler ambient air aspirated with the filaments, the air heats the filaments to a temperature required to activate the latent crimp. The temperature required to activate the latent crimp of the filaments ranges from about 110° F. to a maximum temperature less that the melting point of the lower melting component which for through-air bonded materials is the second component B. The temperature of the air from the heater 24 and thus the temperature to which the filaments am heated can be varied to achieve different levels of crimp. Generally, a higher air temperature produces a higher number of crimps. The ability to control the degree of crimp of the filaments is a particularly advantageous feature of the present invention because it allows one to change the resulting density, pore size distribution and drape of the fabric by simply adjusting the temperature of the air in the fiber draw unit.

The crimped filaments are deposited through the outlet opening of the fiber draw unit 22 onto the traveling forming surface 26. The vacuum 30 draws the filaments against the forming surface 26 to form an unbonded, nonwoven web of continuous filaments. The web is then given a degree of integrity by the compaction roller 34 and through-air bonded in the through-air bonder 36.

In the through-air bonder 36, air having a temperature above the melting temperature of component B and below the melting temperature of component A is directed from the hood 40, through the web, and into the perforated roller 38. Alternatively, the through-air bonder may be a flat arrangement wherein the air is directed vertically downward onto the web. The operating conditions of the two configurations are similar, the primary difference being the geometry of the web during bonding. The hot air melts the lower melting polymer component B and thereby forms bonds between the conjugate filaments to integrate the web. When polypropylene and polyethylene are used as polymer components A and B respectively, the air flowing through the through-air bonder usually has a temperature ranging from about 230° F. to about 325° F. (110° C. to 162° C.). and a velocity from about 100 to about 500 feet per minute. It should be understood, however, that the parameters of the through-air bonder depend on factors such as the type of polymers used and thickness of the web. The web may optionally then be passed through the charged field between the charging bar or wire 48 and the charging drum or roller 42 and then through a second charged field of opposite polarity created between charging bar or wire 50 and charging drum or roller 44. The web may be charged at a range of about 1 kVDC/cm to 12 kVDC/cm.

Lastly, the finished web is wound onto the winding roller 42 and is ready for further processing or use.

Figure 2:
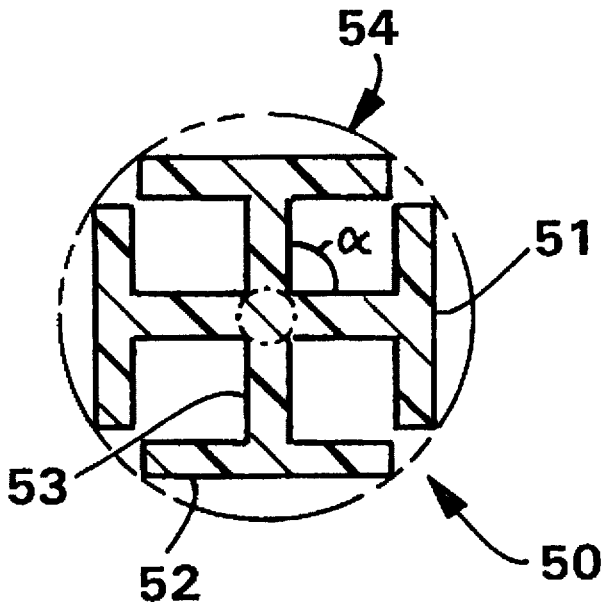
FIGS. 2, 3, 4, and 5 are cross-sectional views of fibers forming the web of this invention.

FIG. 2 shows a preferred shape for a fiber. In FIG. 2, a fiber 50 has four projecting T-shaped lobes 51. Each lobe 51 comprises a cap 52 and a leg 53 intersecting at a center core within an imaginary circular shape 54. The angle of divergence $\alpha$ or this type fiber may vary widely depending on the number of lobes 51. In general, the angle $\alpha$, will be from about 80 to 130 degrees. More particularly, when the fiber has four lobes 51, the angle $\alpha$ will be between 90±5 degrees. When the fiber has three lobes as in FIGS. 3, 4 and 5 the angle $\alpha$ will be 120±10 degrees. The length of the leg 53 and cap 52 may vary, providing that adjacent caps 52 do not touch, as an opening must exist to permit the entrance of liquid treatment chemical as well as, if the fabric is to be used as a filter, to allow the entrance of the fluid to be filtered.

In fibers having legs and caps and which are to be through-air bonded, at least an outermost portion of at least one cap, though not necessarily all of the caps depending on the degree of bonding desired, must be made from a lower melting point polymer than that used for the legs or central portion of the fiber. This is necessary since, as explained above, through-air bonding results in the melting of one of the components of the web.

Figure 3:
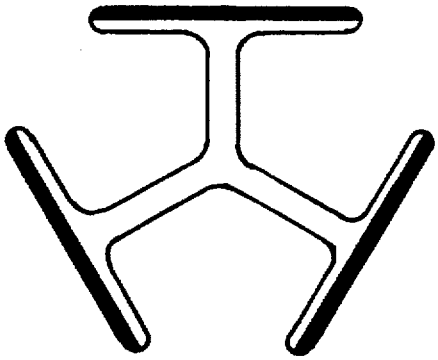
Figure 4:
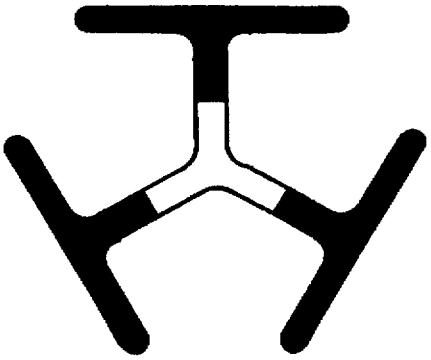
Figure 5:
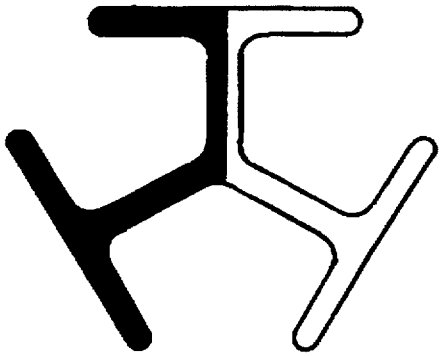

FIGS. 3, 4 and 5 illustrate a tri-lobal fiber having varying proportions of two polymers represented by light and dark areas in the drawings. FIG. 3 has a relatively small proportion of the lower melting component located on the outer part of the caps only. The inventors believe that a fiber like that in FIG. 3 would perform well in through-air bonding. FIG. 4 has a larger proportion of the lower melting component and it extends from the cap into the legs. The central portion of FIG. 4 is made from the higher melting component. The fiber in FIG. 4 should perform well in splittable fiber applications. FIG. 5 shows an embodiment wherein the two polymers are in approximately equal proportion in mirror-image arrangement. The fiber of FIG. 5 should provide a high degree of crimp by virtue of the arrangement of the polymers. Other combinations could of course be developed using different proportions of polymers in different configurations and including additional polymers as separate components or as blends. In addition, mixtures of types and/or deniers of fibers is possible and would give different properties than a web comprised of one type and denier of fiber. For example, two widely varying denier fibers together in one web would produce a web having small and large pores while a web where all the fibers were about the same denier would produce a web having less variation in pore size. Varying pore size in one fabric may be an advantage in some filtration applications.

When the fabric made from the unique fibers of this invention are made from polyolefins and used in transportation vehicle cabin air filtration, they are generally treated with a surfactant prior to the addition of an odor treatment chemical. The o surfactant treatment is necessary when using aqeous based odor treatment chemical impregnants because of the hydrophobic nature of polyolefins. Other polymers could be chosen which would be hydrophilic and not need such surfactant treatments depending on the economics of treatment cost versus polymer cost. Few polymers are as inexpensive as polyolefins, however. When used as a filter, the fabric or web should have a basis weight in the range of about 13 and 300 gsm or more particularly between about 50 and 135 gsm.

When the fabric of this invention is used in a personal care product, treatments may or may not be necessary depending on the specific use. A diaper outercover, for example, is usually hydrophobic to prevent leakage. A liner, on the other hand, is usually designed to pass liquids quickly away from the body and into an inner absorbent layer. Used as a liner, polyolefin fibers of this invention would probably need a surfactant treatment to increase the transmission rate. Its also possible that the fabric may be used as an absorbent layer and again, surfactant treatment would be necessary in the case of normally hydrophobic fibers. When used in a personal care product, the fabric or web should have a basis weight in the range of about 3 and 200 gsm or more particularly between about 3 and 75 gsm.

It has been found that the fibers of this invention provide excellent wicking properties which are especially useful in personal care products where moving liquids away from the skin is critically important.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus function claims are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A conjugate multilobal fiber having an average diameter larger than 7 microns, where said fiber has a cross-section comprised of a central core having lobes projecting therefrom each of said lobes having a leg and a cap, the legs of each of said lobes intersecting at the center of said core, said fiber further comprising at least two polymers wherein said polymers are arranged with a first polymer occupying s portion of said fiber and at least one second polymer having a lower melting point than said first polymer occupying an outer portion of said fiber.

2. The fiber of claim 1 wherein said first polymer is polypropylene and said second polymer is a polyolefin having a lower melting point than polypropylene and wherein said fiber can hold liquid adjacent said lobes.

3. The fiber of claim 1 wherein said first polymer is polypropylene and said second polymer is an adhesive polymer having a lower melting point than polypropylene and wherein said fiber can hold liquid adjacent said lobes.

4. The fiber of claim 1 wherein said cap has an outer edge and said second polymer occupies said outer edge of said caps.

5. The conjugate multilobal spunbond fiber of claim 1 said first and second polymers each occupy caps and legs in approximately a mirror image of each other.

6. The conjugate multilobal spunbond fiber of claim 1 wherein said fibers have three lobes.

7. The conjugate multilobal spunbond fiber of claim 1 wherein said fibers have four lobes.

* * * * *

UNITED STATES PATENT AND TRADEMARK OFFICE

CERTIFICATION OF CORRECTION

PATENT NO. : 5,707,735

DATED : January 13, 1998

INVENTOR(S): Midkiff et al.

It is certified that error appears in the above-identified patent and that said Letters Patent is hereby corrected as shown below:

Column 1, line 58, "of of polymers" should read --of polymers--,
Column 2, line 50, "fo" should read --on--,
Column 3, line 65, "crossection" should read --cross section--,
Column 4, line 28, "0,097" should read --.097--,
Column 4, line 43, "in" should read --is--,
Column 5, line 3, "passengers'air" should read --passengers' air--,
Column 5, line 11, "carded" should read --carried--,
Column 5, line 17, "techniques" should read --techniques,--,
Column 7, line 20, "Atochem Inc." should read --Atochem Inc., Polymers Division, of Glen Rock, N.J. (Rilsan® nylons), among others.--,
Column 7, lines 21-22, "Polymers Division, of Glen Rock, N.J. (Rilsan® nylons), among others." should be deleted.
Column 7, line 32, "resins," should read --resins--,
Column 8, line 3, "throughair" should read --through-air--,
Column 8, line 18, "Its" should read --It's--,
Column 8, line 31, the sentence beginning "After through-air...." should start a new paragraph,
Column 8, line 35, "carded" should read --carried--,
Column 8, line 58, "et al," should read --et al.,--,
Column 9, line 2, "spunbond/spunbond" should read --spunbond/spunbond laminate. An SMS laminate--,
Column 9, line 7, the sentence beginning "Alternatively, ...." should be part of the previous paragraph,
Column 9, line 9, "individually." should read --individually,--,
Column 9, line 21, "place" should read --placed--,
Column 10, line 2, "am" should read --are--,
Column 10, line 34, "the-polymers" should read --the polymers--,
Column 10, line 56, "that" should read --than--,

UNITED STATES PATENT AND TRADEMARK OFFICE

CERTIFICATION OF CORRECTION

PATENT NO. : 5,707,735

DATED : January 13, 1998

INVENTOR(S): Midkiff et al.

It is certified that error appears in the above-identified patent and that said Letters Patent is hereby corrected as shown below:

Column 10, line 60, "am" should read --are--,
Column 11, line 22, "(110°C. to 162°C.)." should read --(110°C. to 162°C.)--,
Column 12, line 21, "The O sufractant" should read --The surfactant--,
Column 12, line 23, "aqeous" should read --aqueous--,
Column 12, line 39, "Its" should read –It's--, Column 13, line 2, "therefrom" should read --therefrom,--,
Column 13, line 5, "s" should read --a--.

Signed and Sealed this

Twenty-ninth Day of August, 2000

*Attest:*

Q. TODD DICKINSON

*Attesting Officer*

*Director of Patents and Trademarks*